US009614333B2

(12) United States Patent
Tsai et al.

(10) Patent No.: US 9,614,333 B2
(45) Date of Patent: Apr. 4, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Yang-Yang Zhou, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/147,107

(22) Filed: May 5, 2016

(65) Prior Publication Data

US 2016/0329667 A1 Nov. 10, 2016

(30) Foreign Application Priority Data

May 5, 2015 (CN) ..... 2015 1 0222860

(51) Int. Cl.
*H01R 12/00* (2006.01)
*H01R 24/70* (2011.01)
*H01R 13/52* (2006.01)

(52) U.S. Cl.
CPC ..... *H01R 24/70* (2013.01); *H01R 13/52* (2013.01)

(58) Field of Classification Search
CPC H01R 12/526; H01R 12/707; H01R 43/0235; H01R 43/0256
USPC .... 439/83, 910, 912, 607.4, 607.35, 607.38, 439/876
See application file for complete search history.

(56) References Cited

U.S. PATENT DOCUMENTS 4,504,887 A * 3/1985 Bakermans ..... H05K 7/1069 174/559
5,096,440 A * 3/1992 Katsumata ..... H01R 9/091 439/566
5,697,799 A * 12/1997 Consoli ..... H01R 23/6873 439/181
5,975,920 A * 11/1999 Oberstarr ..... H01R 9/091 439/83
7,140,918 B1 * 11/2006 Delaney ..... H01R 23/6873 439/607.06

(Continued)

FOREIGN PATENT DOCUMENTS

CN 104538781 4/2015
CN 104538782 4/2015

(Continued)

*Primary Examiner* — Phuong Dinh
(74) *Attorney, Agent, or Firm* — Muncy, Geissler, Olds & Lowe, P.C.

(57) ABSTRACT

An electrical receptacle connector includes a metallic shell, an insulated housing, a plurality of first receptacle terminals, a plurality of second receptacle terminals, a recess structure, and a passage structure. The insulated housing is received in the receiving cavity. The first receptacle terminals and the second receptacle terminals are respectively disposed at an upper portion and a lower portion of the insulated housing. The recess structure and the passage structure are formed at the rear of the insulated housing, so that a sealing member can be filled in the recess structure and the passage structure to cover and shields the rear of the insulated housing.

10 Claims, 9 Drawing Sheets

(56) References Cited

U.S. PATENT DOCUMENTS 8,506,332 B2 * 8/2013 Sommers ..... H01R 12/725
439/607.32

FOREIGN PATENT DOCUMENTS

| | | |
|---|---|---|
| CN | 204289872 | 4/2015 |
| TW | M497869 | 3/2015 |
| TW | M531676 | 11/2016 |

* cited by examiner

100

| | | | | | | | | | | | | |
|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 5

ELECTRICAL RECEPTACLE CONNECTOR

CROSS-REFERENCES TO RELATED APPLICATIONS

This non-provisional application claims priority under 35 U.S.C. §119(a) on Patent Application No. 201510222860.4 filed in China, P.R.C. on May 5, 2015, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, receptacle terminals held on the plastic core, and an outer iron shell circularly enclosing the plastic core.

However, the rear of the hollowed iron shell of the conventional USB Type-C connector is devoid of any waterproof structure for preventing moist from going from the front to the rear. In other words, the rear of the iron shell is devoid of sealing structure, so that gaps may be formed between the rear of the plastic core and other components. Therefore, moist may enter into the connector from the gaps and further cause damages to the electronic device having the connector; that is, moist may attach onto the circuit board inside the electronic device to affect the operation of the electronic device.

SUMMARY OF THE INVENTION

Accordingly, how to improve the existing connector becomes an issue.

In view of this, an embodiment of the instant disclosure provides an electrical receptacle connector. The electrical receptacle connector comprises a metallic shell, an insulated housing, a plurality of first receptacle terminals, a plurality of second receptacle terminals, a recess structure, and a passage structure. The metallic shell comprises a shell body and a receiving cavity formed therein. The insulated housing is received in the receiving cavity. The insulated housing comprises a base portion and a tongue portion extending from one of two sides of the base portion. The tongue portion has a first surface (i.e., upper surface) and a second surface (i.e., lower surface) opposite to the first surface. The first receptacle terminals comprise a plurality of first signal terminals, at least one power terminal, and at least one ground terminal. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction, and extending out of the base portion. The second receptacle terminals comprise a plurality of second signal terminals, at least one power terminal, and at least one ground terminal. Each of the second receptacle terminals is held in the insulated housing and disposed at the second surface. Each of the second receptacle terminals comprises a flat contact portion, a body portion, and a tail portion. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction and extending out of the base portion. The recess structure is formed between the other side of the base portion and the inner wall of the shell body. The passage structure is formed between the other side of the base portion and the inner wall of the shell body. The recess structure communicates with the passage structure. The recess structure and the passage structure are formed at the rear of the receiving cavity of the shell body. Based on the above, the recess structure and the passage structure is at the rear of the metallic shell and the rear of the insulated housing for filling the sealing member in liquid state, so that the sealing member is filled in the recess structure and further filled into the passage structure to fill the rear of the receiving cavity of the shell body. After the sealing member is dried and set to form the waterproof glue block, the waterproof glue block covers and shields the rear of the metallic shell and the rear of the insulated housing. Therefore, the sealing member can prevent water moist stayed at the insertion opening of the front of the metallic shell from penetrating into the rear of the metallic shell through the receiving cavity. In addition, the insulated housing further comprises a stopping block disposed at a corner between the top surface of the rear side plate and the base portion. The stopping block, the base portion, and the inner wall of the shell body define the recess structure. Because of the stopping block, the volume of the recess structure is reduced, and the volume of the sealing member for filling into the recess structure can be reduced as well, while the sealing member can still provide covering and waterproofing functions.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 5 illustrates a schematic configuration diagram of the receptacle terminals of the electrical receptacle connector shown in FIG. 4;

DETAILED DESCRIPTION

Figure 1:
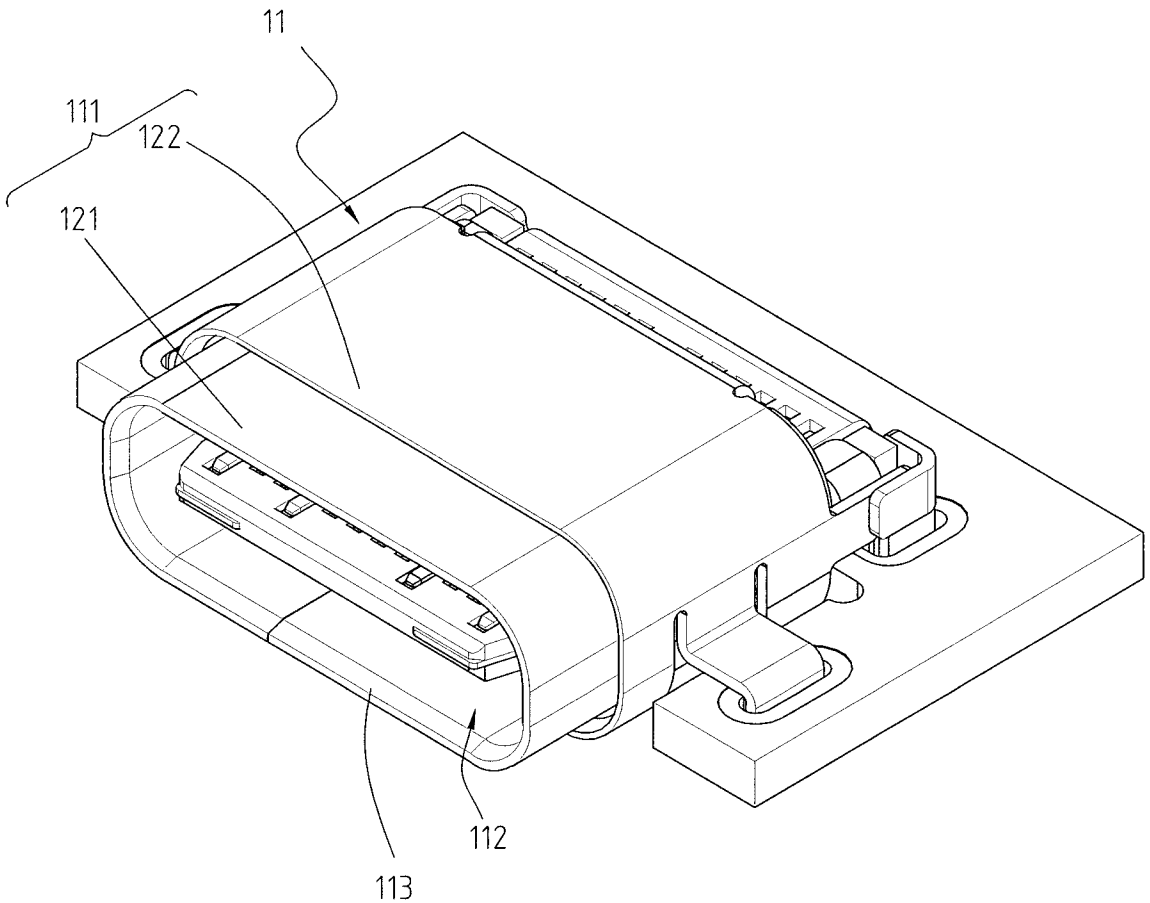
FIG. 1 illustrates a perspective view (1) of an electrical receptacle connector according to an exemplary embodiment of the instant disclosure.
Figure 2:
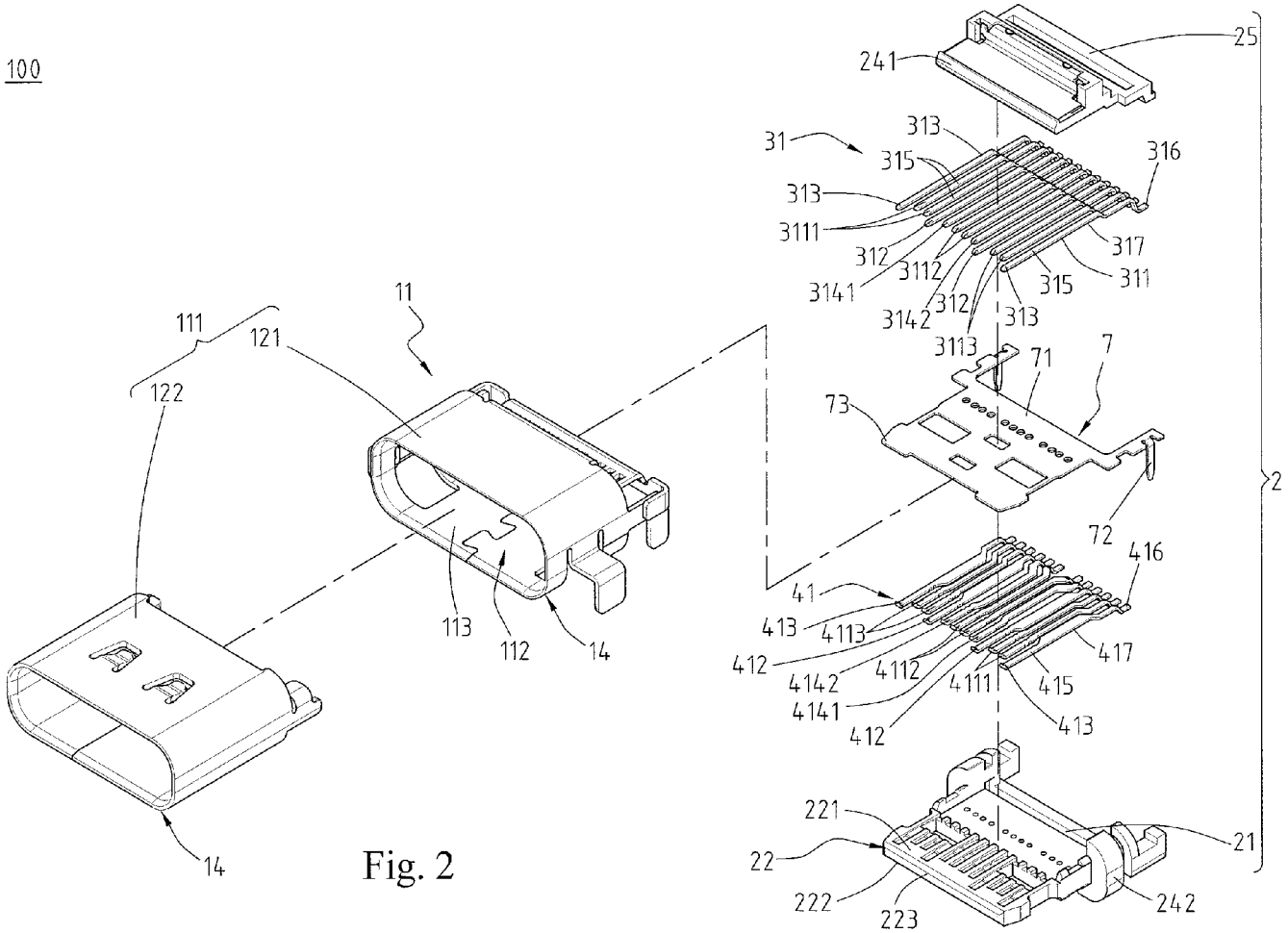
FIG. 2 illustrates an exploded view of the electrical receptacle connector.
Figure 3:
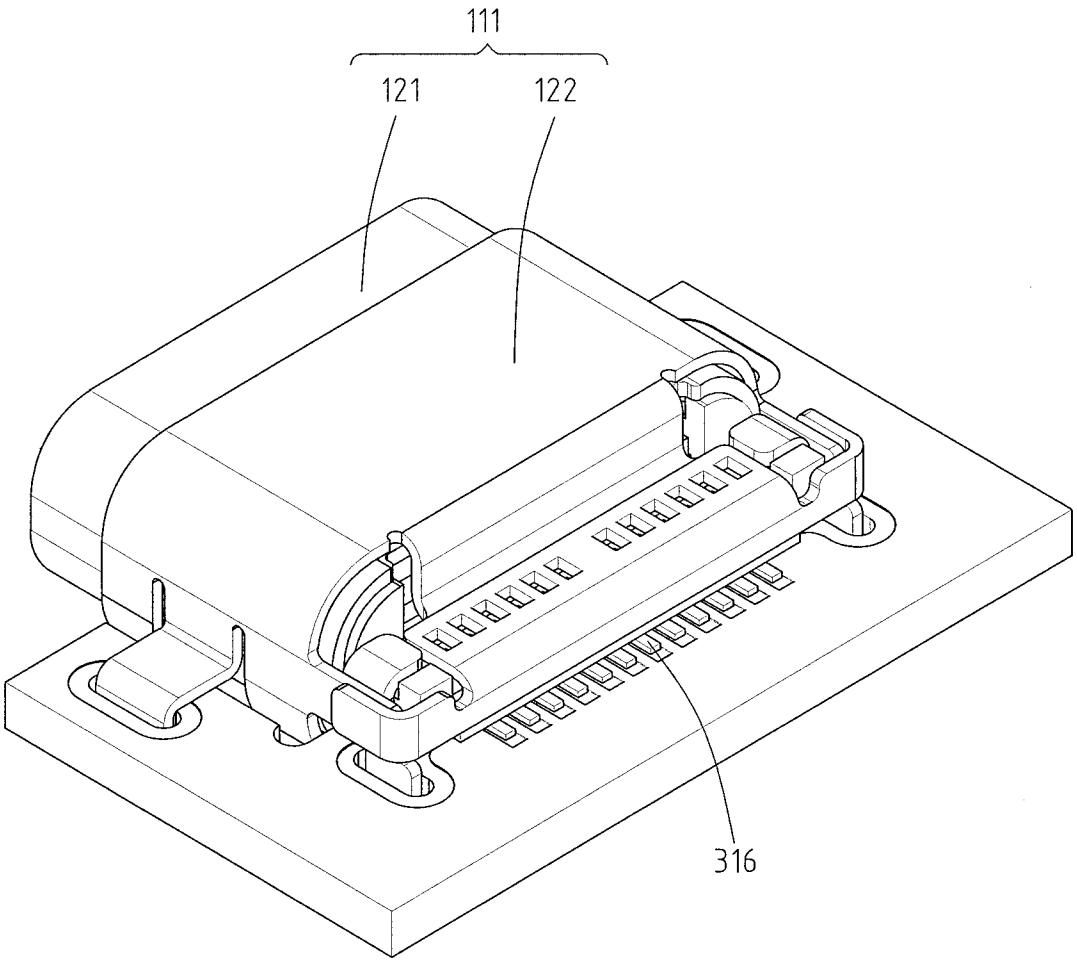
FIG. 3 illustrates a perspective view (2) of the electrical receptacle connector.
Figure 4:
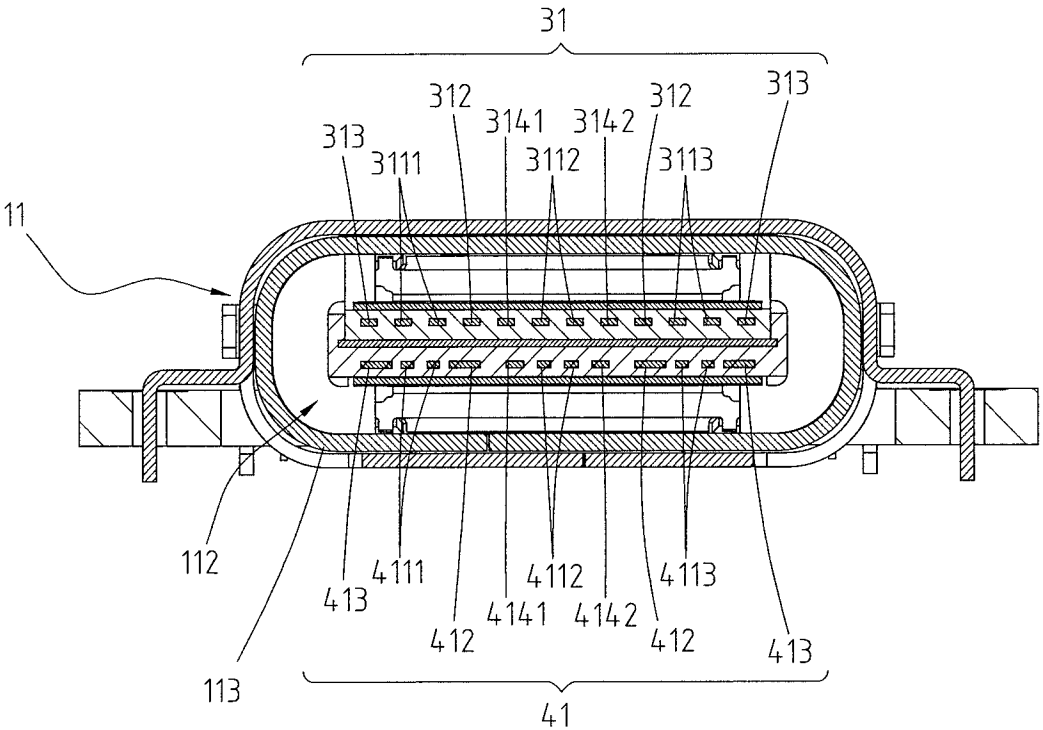
FIG. 4 illustrates a front sectional view of the electrical receptacle connector.

Please refer to FIGS. 1 to 4, which illustrate an electrical receptacle connector 100 of an exemplary embodiment of the instant disclosure. FIG. 1 illustrates a perspective view (1) of an electrical receptacle connector 100. FIG. 2 illustrates an exploded view of the electrical receptacle connector 100. FIG. 3 illustrates a perspective view (2) of the electrical receptacle connector 100. FIG. 4 illustrates a front sectional view of the electrical receptacle connector 100. In this embodiment, the electrical receptacle connector 100 is assembled with a circuit board by sinking technique. That is, one side of the circuit board is cut to form a crack, and the electrical receptacle connector 100 is positioned at the crack and extending toward the side portion of the circuit board, but embodiments are not limited thereto. In some embodiments, the electrical receptacle connector 100 may be directly soldered on the surface of the circuit board. In other words, in such embodiment, the circuit board does not have the crack for receiving the electrical receptacle connector 100, and the electrical receptacle connector 100 can be freely assembled on and electrically connected to any portion of the surface of the circuit board without altering the structure of the components inside the connector. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, an insulated housing 2, a plurality of first receptacle terminals 31, a plurality of second receptacle terminals 41, a recess structure 5, and a passage structure 6.

The metallic shell 11 is a hollowed shell, and the metallic shell 11 comprises a shell body 111 and a receiving cavity 112 formed in the shell body 111. In this embodiment, the shell body 111 is a tubular structure and defines the receiving cavity 112 therein. While in some embodiments, the metallic shell 11 may be formed by a multi-piece member; in such embodiments, the shell body 111 further comprises an inner shell 121 and a case 122. The inner shell 121 is a tubular structure 14 circularly enclosing the insulated housing 2, and the inner shell 121 may be a seamless, hollowed tubular structure 14 formed by applying deep drawing technique to a metal sheet to gradually deform the metal sheet by repeated pressing operations; alternatively, the inner shell 121 may be a seamed, hollowed tubular structure 14 formed by bending a metal sheet. The case 122 may be a tubular structure 14 circularly enclosing the inner shell 121, but embodiments are not limited thereto. Alternatively, the case 122 may be a semi-tubular structure which has a U-shaped cross section, and the case 122 can be covered on the top and two sides of the inner shell 121 and provided as an outer shell structure of the inner shell 121. In addition, an inserting opening 113 with oblong shaped is formed at one side of the metallic shell 11, and the inserting opening 113 communicates with the receiving cavity 112.

The insulated housing 2 is received in the receiving cavity 112 of the metallic shell 11. The insulated housing 2 comprises a base portion 21 and a tongue portion 22. In this embodiment, the insulated housing 2 further comprises a first portion 241 and a second portion 242. The first portion 241 and the second portion 242 are assembled with each other. After the first portion 241 and the second portion 242 are assembled with each other, the assembly of the first portion 241 and the second portion 242 forms the base portion 21 and the tongue portion 22. The base portion 21 and the tongue portion 22 may be made by injection molding or the like to form the insulated housing 2, so that the base portion 21 and the tongue portion 22 are produced integrally as a whole. In addition, a grounding plate 7 is formed in the base portion 21 and the tongue portion 22. In this embodiment, the first receptacle terminals 31 are insert-molded with the first portion 241, and the second receptacle terminals 41 are insert-molded with the second portion 242. Moreover, the tongue portion 22 is extending from one of two sides of the base portion 21. The tongue portion 22 is in the front of the receiving cavity 112, while the base portion 21 is in the rear of the receiving cavity 112. The rear of the base portion 21 is not aligned with the end portion 1211 of the rear of the inner shell 121; namely, after the base portion 21 is received in the receiving cavity 112, the rear of the base portion 21 and the end portion 1211 of the rear of the inner shell 121 defines a recess. The tongue portion 22 has two opposite surfaces, one is a first surface 221 (i.e., the upper surface), and the other is a second surface 222 (i.e., the lower surface).

In addition, the front lateral surface 223 of the tongue portion 22 is connected the first surface 221 with the second surface 222 and is close to the insertion opening 113. In other words, the front lateral surface 223 is adjacent to the insertion opening 113 and perpendicularly connected to the first surface 221 and the second surface 222, respectively. In this embodiment, the insulated housing 2 further comprises a rear side plate 25 extending outward from the middle of the rear of the base portion 21. Moreover, the rear side plate 25 is protruded from the receiving cavity 112 of the shell body 111.

Figure 6:
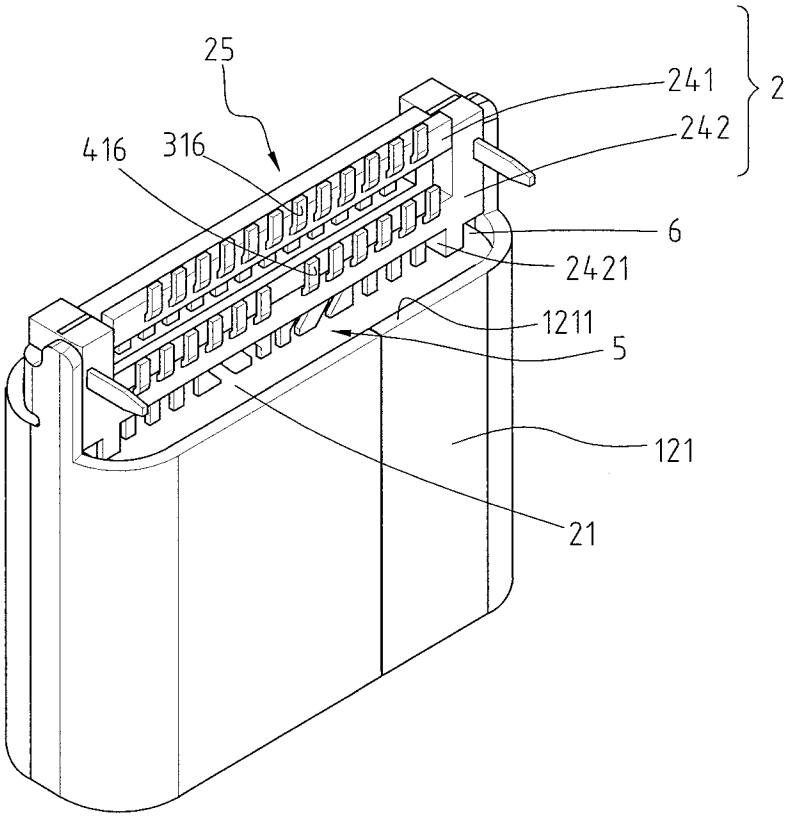
FIG. 6 illustrates a standing perspective view of the electrical receptacle connector.
Figure 7:
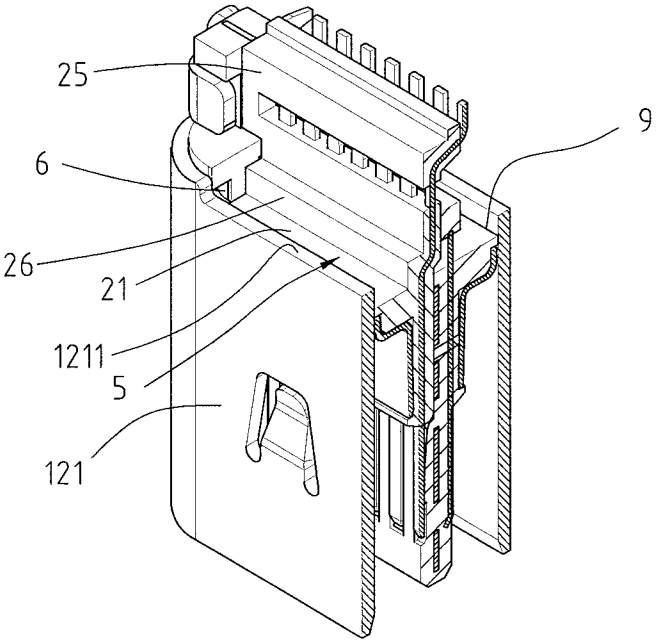
FIG. 7 illustrates a sectioned perspective view of the electrical receptacle connector.

Please refer to FIGS. 6 and 7. The recess structure 5 is formed between the other side of the base portion 21 and the inner wall of the shell body 111. In other words, the recess structure 5 is formed between the other side of the base portion 21 and the inner wall of the inner shell 121. From a sectional view of the base portion 21, the rear side plate 25, and the shell body 111, the base portion 21 forms the bottom of the recess structure 5, the rear side plate 25 forms the left wall of the recess structure 5, and the inner wall of the shell body 111 forms the right wall of the recess structure 5. The base portion 21, the rear side plate 25, and the shell body 111 define three walls of the recess structure 5, and the top of the recess structure 5 is opened and exposed. In other words, the rear of the base portion 21 is divided into an upper rear portion and a lower rear portion by the rear side plate 25, and the upper rear portion and the lower rear portion of the rear of the base portion 21 are flat surfaces. The rear side plate 25, the rear of the base portion 21, and the inner wall of the inner shell 121 define the recess structure 5. In this embodiment, two recess structures 5 are formed at the upper rear portion and the lower rear portion, respectively, and the recess structures 5 are for being filled by a sealing member 8 in liquid state, but embodiments are not limited thereto. In some embodiments, the recess structure 5 is formed at the upper rear portion or the lower rear portion, for being filled by a sealing member 8 in liquid state. Alternatively, the sealing member 8 may be further filled into the passage structure 6 from the recess structure 5, so that the rear of the insulated housing 2 is completely filled by the sealing member 8.

Please refer to FIGS. 6 and 7. The passage structure 6 is formed between the other side of the base portion 21 and the inner wall of the shell body 111. In other words, the electrical receptacle connector 100 may comprise several passage structures 6. In such embodiment, the rear of the base portion 21 is divided into a left rear portion and a right rear portion, and the passage structures 6 are respectively formed at the left rear portion and the right rear portion, and between the other side of the base portion 21 and the inner wall of the inner shell 111. From a sectional view of the base portion 21, the rear side plate 25, and the shell body 111, the base portion 21 forms the bottom of the passage structure 6, the rear side plate 25 forms the left wall and the top of the passage structure 6, and the shell body 111 forms the right wall of the passage structure 6. The base portion 21, the rear side plate 25, and the shell body 111 define the four side closed passage structure 6. In addition, the passage structure 6 communicates with the recess structure 5 (i.e., the front and the rear of the passage structure 6 is opened and communicates with the recess structure 5), and the recess structure 5 and the passage structure 6 are both formed at the rear of the receiving cavity 112 of the shell body 111.

Figure 8:
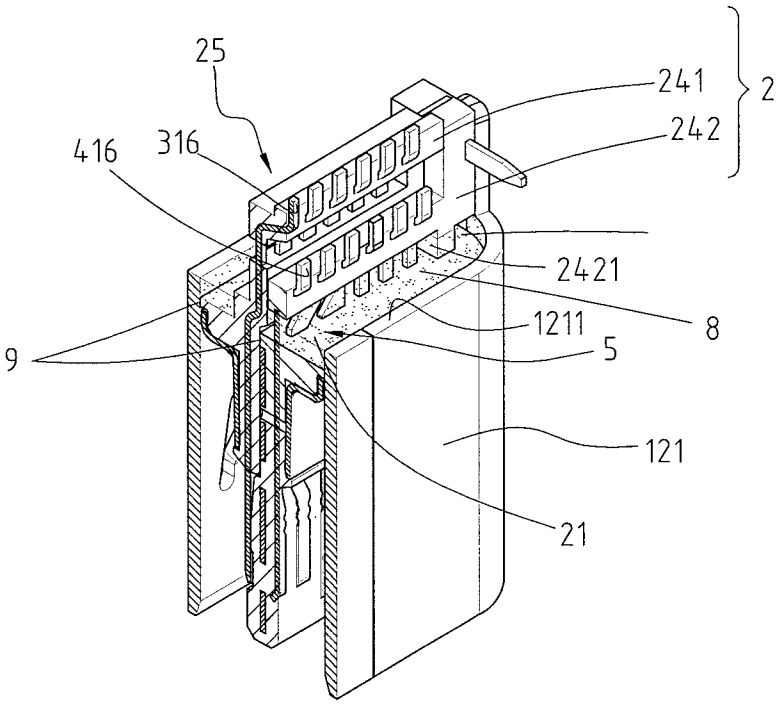
FIG. 8 illustrates a sectioned perspective view (1) of the electrical receptacle connector after the electrical receptacle connector is processed.
Figure 9:
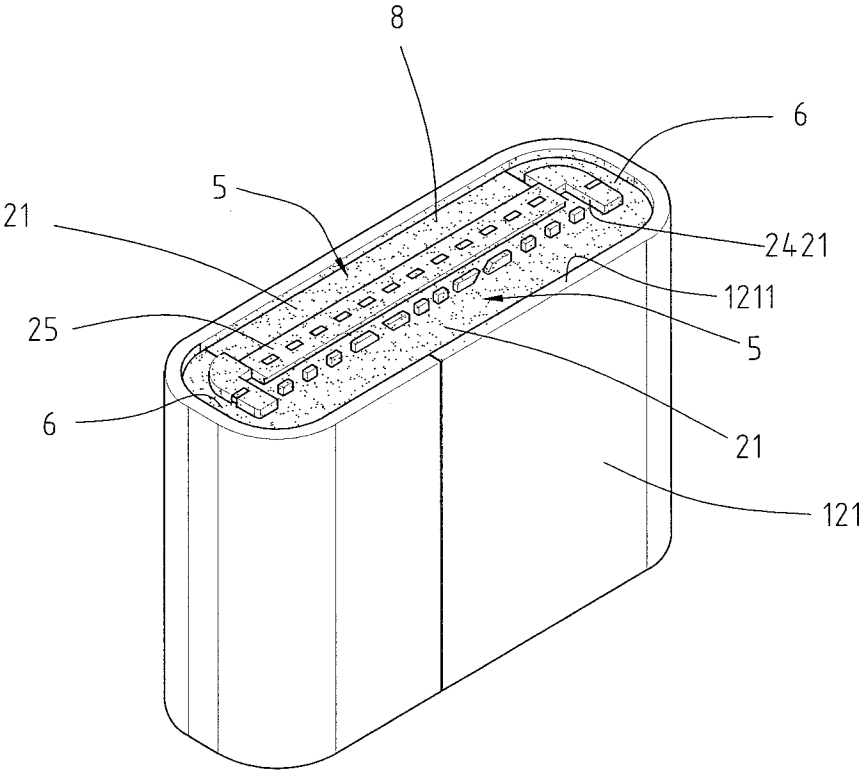
FIG. 9 illustrates a sectioned perspective view (2) of the electrical receptacle connector after the electrical receptacle connector is processed.

Please refer to FIGS. 8 and 9. The sealing member 8 is a waterproof glue block formed by drying and solidifying a liquid. In this embodiment, before the sealing member 8 is dried and set, the sealing member 8 is filled in the recess structure 5 and the passage structure 6, and it is also filled in the gap 9 between the other side of the base portion 21 and the inner wall of the shell body 111. In other words, the sealing member 8 is filled in the recess structure 5 and further filled into the passage structure 6 to fill the rear of the receiving cavity 112 of the shell body 111; moreover, the sealing member 8 covers the gap 9 between the other side of the base portion 21 and the inner wall of the shell body 111. Therefore, after the sealing member 8 is dried and set, the sealing member 8 can prevent water moist stayed at the insertion opening 131 of the front of the metallic shell 11 from penetrating into the rear of the metallic shell 11 through the receiving cavity 112. Accordingly, when the electrical receptacle connector 100 is assembled to an electronic device, water moist cannot enter into the electronic device through the electrical receptacle connector 100 and would not affect the operation of electronic components on a circuit board of the electronic device.

Please refer to FIG. 7. The insulated housing 2 further comprises a stopping block 26 disposed at a corner between the top surface of the rear side plate 25 (which corresponds to the upper rear portion of the base portion 21) and the base portion 21. The stopping block 26, the base portion 21, and the inner wall of the shell body 111 define the recess structure 5. Because of the stopping block 26, the volume of the recess structure 5 is reduced, and the volume of the sealing member 8 for filling into the recess structure 5 can be reduced as well, while the sealing member 8 can still provide covering and waterproofing functions.

Please refer to FIGS. 6 and 8. The second portion 242 of the insulated housing 2 may further have a groove 2421, the groove 2421 corresponds to the recess structure 5, and the inner lateral surface of the groove 2421 is just the lateral surface of the first portion 241. The groove 2421 is defined through the second portion 242 and corresponds to the rear side plate 25. After the sealing member 8 is filled in the recess structure 5, the sealing member 8 is further filled into the groove 2421. Therefore, after the sealing member 8 is dried and set to form the waterproof glue block, the waterproof glue block covers and shields a gap between the first portion 241 and the second portion 242 (it is understood that the gap between the first portion 241 and the second portion 242 may be formed because the first portion 241 is not perfectly mated with the second portion 242), so that water moist can be prevented from penetrating into the interior of the electrical receptacle connector 100 through the gap between the first portion 241 and the second portion 242, and a waterproof function can be provided.

Please refer to FIGS. 2 to 5. The first receptacle terminals 31 comprise a plurality of first signal terminals 311, at least one power terminal 312, and at least one ground terminal 313. Referring to FIG. 5, the first receptacle terminals 31 comprise, from left to right, a ground terminal 313 (Gnd), a first pair of first signal terminals 3111 (TX1+−, differential signal terminals for high speed signal transmission), a power terminal 312 (Power/VBUS), a first function detection terminal 3141 (CC1, a terminal for inserting orientation detection of the connector and for cable recognition), a second pair of first signal terminals 3112 (D+−, differential signal terminals for low speed signal transmission), a supplement terminal 3142 (SBU1, a terminal can be reserved for other purposes), another power terminal 312 (Power/VBUS), a third pair of first signal terminals 3113 (RX2+−, differential signal terminals for high speed signal transmission), and another ground terminal 313 (Gnd). In this embodiment, twelve first receptacle terminals 31 are provided for transmitting USB 3.0 signals. In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the rightmost ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2 to 5. The first receptacle terminals 31 are held in the base portion 21 and the tongue portion 22. In this embodiment, the first receptacle terminals 31 are combined with the first portion 241. Each of the first receptacle terminals 31 comprises a flat contact portion 315, a body portion 317, and a tail portion 316. For each of the first receptacle terminals 31, the body portion 317 is held in the base portion 21 and the tongue portion 22, the flat contact portion 315 is extending forward from the body portion 317 in the rear-to-front direction and partly exposed upon the first surface 221 of the tongue portion 22, and the tail portion 316 is extending backward from the body portion 317 in the front-to-rear direction and protruded from the base portion 21. The first signal terminals 311 are disposed at the first surface 221 and transmit first signals (namely, USB 3.0 signals). The tail portions 316 are protruded from the bottom of the base portion 21. In addition, the tail portions 316 may be, but not limited to, bent horizontally to form flat legs, named SMT (surface mounted technology) legs, which can be mounted or soldered on the surface of a printed circuit board by using surface mount technology. In some embodiments, the tail portions 316 are extending downwardly to form vertical legs, named through-hole legs, that are inserted into holes drilled in a printed circuit board by using through-hole technology.

Please refer to FIGS. 2 to 5. The second receptacle terminals 41 comprise a plurality of second signal terminals 411, at least one power terminal 412, and at least one ground terminal 413. Referring to FIG. 5, the second receptacle terminals 41 comprise, from right to left, a ground terminal 413 (Gnd), a first pair of second signal terminals 4111 (TX2+−, differential signal terminals for high speed signal transmission), a power terminal 412 (Power/VBUS), a second function detection terminal 4141 (CC2, a terminal for inserting orientation detection of the connector and for cable recognition), a second pair of second signal terminals 4112 (D+−, differential signal terminals for low speed signal transmission), a supplement terminal 4142 (SBU2, a terminal can be reserved for other purposes), another power terminals 412 (Power/VBUS), a third pair of second signal terminals 4113 (RX1+1, differential signal terminals for high speed signal transmission), and another ground terminal 413 (Gnd). In this embodiment, twelve second receptacle terminals 41 are provided for transmitting USB 3.0 signals. In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2 to 5. The second receptacle terminals 41 are held in the base portion 21 and the tongue portion 22. In this embodiment, the second receptacle terminals 41 are combined with the second portion 241. The length of each of the first receptacle terminals 31 is greater than that of the corresponding second receptacle terminal 41; that is, the exposed length of each of the first receptacle terminals 31 is greater than that of the corresponding second receptacle terminal 41. Each of the second receptacle terminals 41 comprises a flat contact portion 415, a body portion 417, and a tail portion 416. For each of the second receptacle terminals 41, the body portion 417 is held in the base portion 21 and the tongue portion 22, the flat contact portion 415 is extending from the body portion 417 in the rear-to-front direction and partly exposed upon the second surface 222 of the tongue portion 22, and the tail portion 416 is extending backward from the body portion 417 in the front-to-rear direction and protruded from the base portion 21. The second signal terminals 411 are disposed at the second surface 222 and provided for transmitting second signals (i.e., USB 3.0 signals). The tail portions 416 are protruded from the bottom of the base portion 21. In addition, the tail portions 416 may be, but not limited to, bent horizontally to form flat legs, named SMT legs, which can be mounted or soldered on the surface of a printed circuit board by using surface mount technology.

Please refer to FIGS. 2 to 5. In this embodiment, the first receptacle terminals 31 and the second receptacle terminals 41 are respectively disposed at the first surface 221 and the second surface 222 of the tongue portion 22. Additionally, pin-assignments of the first receptacle terminals 31 and the second receptacle terminals 41 are point-symmetrical with a central point of the receiving cavity 112 as the symmetrical center. In other words, pin-assignments of the first receptacle terminals 31 and the second receptacle terminals 41 have 180 degree symmetrical design with respect to the central point of the receiving cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221 is facing up, for transmitting first signals. Conversely, the electrical plug connector is inserted into the electrical receptacle connector 100 with a second orientation where the first surface 221 is facing down, for transmitting second signals.

Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Please refer to FIGS. 2 to 5. In this embodiment, as viewed from the front of the receptacle terminals 31, 41, the position of the first receptacle terminals 31 corresponds to the position of the second receptacle terminals 41.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIG. 6. In this embodiment, the tail portions 316, 416 are protruded from the base portion 211 and arranged separately. The tail portions 316, 416 may be arranged into two parallel rows. Alternatively, the tail portions 416 may be aligned into two rows and the first row of the tail portions 416 is aligned by an offset with respect to the second row of the tail portions 416; thus, the tail portions 316, 416 form three rows.

Please refer to FIGS. 2 to 5. In this embodiment, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. In addition, the position of the tail portions 316 may correspond to the position of the tail portion 416. Alternatively, the tail portions 316 may be aligned by an offset with respect to the tail portions 416. Accordingly, because of the offset alignment of the receptacle terminals 31, 41, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of first signal terminals 3111 (TX1+−) and the third pair of first signal terminals 3113 (RX2+−) are omitted, and the second pair of first signal terminals 3112 (D+−) 41 and the power terminals 312 (Power/VBUS) are retained. While for the second receptacle terminals 41 in accordance with transmission of USB 2.0 signals, the first pair of second signal terminals 4111 (TX2+−) and the third pair of second signal terminals 4113 (RX1+−) are omitted, and the second pair of second signal terminals 4112 (D+−) and the power terminals 412 (Power/VBUS) are retained.

Please refer to FIGS. 2 and 4. In some embodiments, the electrical receptacle connector 100 further comprises a grounding plate 7 at the insulated housing 2. The grounding plate 7 comprises a plate body 71 and a plurality of legs 72. The plate body 71 is between the flat contact portions 315 of the first receptacle terminals 31 and the flat contact portions 415 of the second receptacle terminals 41. In other words, the plate body 71 is held in the base portion 21 and the tongue portion 22 and between the flat contact portions 315, 415. In addition, the legs 72 are respectively extending downward from two sides of the plate body 71 and extending out of the bottom of the base portion 21. The legs 72 are in contact with the contacts of the circuit board. Moreover, the legs 72 may be extending backward from the two sides of the plate body 71 toward the rear of the base portion 21, and the legs 72 are in contact with the case 122. The crosstalk interference can be reduced by the shielding of the grounding plate 7 when the flat contact portions 315, 415 transmit signals. Furthermore, the structural strength of the tongue portion 22 can be improved by the assembly of the grounding plate 7. Moreover, the legs 72 extending downward from the two sides of the plate body 71 may be provided as through-hole legs, and the legs 72 are exposed from the base portion 21 to be in contact with the circuit board. Furthermore, the grounding plate 7 comprises a plurality of hooks 73 protruded from two sides of the tongue portion 22. When an electrical plug connector is mated with the electrical receptacle connector 100, elastic pieces at two sides of an insulated housing of the electrical plug are engaged with the hooks 73, and the elastic pieces would not wear against the tongue portion 22 of the electrical receptacle connector 100. Additionally, the electrical plug connector may further comprise a plurality of protruded abutting portions, and the protruded abutting portions are in contact with the metallic shell 11 of the electrical receptacle connector 100. Hence, the elastic pieces and the protruded abutting portions are provided for conduction and grounding.

Please refer to FIGS. 2 and 4. In this embodiment, the electrical receptacle connector 100 further comprises a plurality of conductive sheets. The conductive sheets are metal elongated plates and may comprise an upper conductive sheet and a lower conductive sheet. The upper conductive sheet is assembled on the upper portion of the base portion 21, and the lower conductive sheet is assembled on the lower portion of the base portion 21. When an electrical plug connector is mated with the electrical receptacle connector 100, the front of a metallic shell of the electrical plug connector is in contact with the conductive sheets, the metallic shell of the electrical plug connector is efficiently in contact with the metallic shell 11 of the electrical receptacle connector 100 via the conductive sheets, and the electromagnetic interference problem can be improved.

Based on the above, the recess structure and the passage structure is at the rear of the metallic shell and the rear of the insulated housing for filling the sealing member in liquid state, so that the sealing member is filled in the recess structure and further filled into the passage structure to fill the rear of the receiving cavity of the shell body. After the sealing member is dried and set to form the waterproof glue block, the waterproof glue block covers and shields the rear of the metallic shell and the rear of the insulated housing. Therefore, the sealing member can prevent water moist stayed at the insertion opening of the front of the metallic shell from penetrating into the rear of the metallic shell through the receiving cavity. In addition, the insulated housing further comprises a stopping block disposed at a corner between the top surface of the rear side plate and the base portion. The stopping block, the base portion, and the inner wall of the shell body define the recess structure. Because of the stopping block, the volume of the recess structure is reduced, and the volume of the sealing member for filling into the recess structure can be reduced as well, while the sealing member can still provide covering and waterproofing functions.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, comprising a shell body and a receiving cavity defined by the shell body;

an insulated housing received in the receiving cavity, wherein the insulated housing comprises a base portion and a tongue portion extending from one of two sides of the base portion, the tongue portion has a first surface and a second surface, and the first surface is opposite to the second surface;

a plurality of first receptacle terminals comprising a plurality of first signal terminals, at least one power terminal, and at least one ground terminal, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion;

a plurality of second receptacle terminals comprising a plurality of second signal terminals, at least one power terminal, and at least one ground terminal, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion;

a recess structure between the other side of the base portion and the inner wall of the shell body; and a passage structure between the other side of the base portion and the inner wall of the shell body and communicating with the recess structure, wherein the recess structure and the passage structure are at the rear of the receiving cavity of the shell body.

2. The electrical receptacle connector according to claim 1, further comprising a sealing member filled in the recess structure, wherein the sealing member is further filled into the passage structure to fill the rear of the receiving cavity of the shell body, the sealing member covers a gap between the other side of the base portion and the inner wall of the shell body.

3. The electrical receptacle connector according to claim 1, wherein the insulated housing further comprises a rear side plate extending outward from the middle portion of the rear of the base portion and protruded out of the receiving cavity of the shell body.

4. The electrical receptacle connector according to claim 3, further comprising a plurality of recess structures respectively formed at an upper portion of rear of the base portion and a lower portion of the rear of the base portion, and the recess structures are between the base portion and the inner wall of the shell body.

5. The electrical receptacle connector according to claim 4, wherein the insulated housing further comprises a stopping block disposed at a corner between the top surface of the rear side plate and the base portion, the stopping block, the base, and the inner wall of the shell body defines the recess structure.

6. The electrical receptacle connector according to claim 3, further comprising a plurality of passage structures respectively formed at a left portion of the rear of the base portion and a right portion of the rear of the base portion, and the passage structures are between the base portion and the inner wall of the shell body.

7. The electrical receptacle connector according to claim 1, wherein the shell body comprises an inner shell and a case, the inner shell is circularly enclosing the insulated housing, the case circularly encloses the inner shell, the recess structure is formed between the other side of the base portion and the inner wall of the inner shell, the passage structure is formed between the other side of the base portion and the inner wall of the inner shell.

8. The electrical receptacle connector according to claim 1, wherein the insulated housing further comprises a first portion and a second portion, the first portion is assembled to the second portion to form the base portion and the tongue portion, and the second portion comprises a groove corresponding to the recess structure.

9. The electrical receptacle connector according to claim 1, wherein the first receptacle terminals and the second receptacle terminals have 180 degree symmetrical design with respect to a central point of the receiving cavity as the symmetrical center.

10. The electrical receptacle connector according to claim 1, wherein the position of the first receptacle terminals corresponds to the position of the second receptacle terminals.

* * * * *